United States Patent [19]

van Duursen

[11] Patent Number: 5,033,725

[45] Date of Patent: Jul. 23, 1991

[54] METHOD OF CHECKING AND COMBINING SEPARATE DOCUMENTS OR PART DOCUMENTS OF THE LETTER AND ENVELOPE TYPE

[75] Inventor: Henk van Duursen, Nr Hastings, England

[73] Assignee: Svecia Antiqua Limited, E. Sussex, England

[21] Appl. No.: 404,515

[22] Filed: Sep. 8, 1989

[30] Foreign Application Priority Data

May 25, 1989 [GB] United Kingdom ..... 8912054

[51] Int. Cl.[5] ..... B65H 39/00

[52] U.S. Cl. ..... 270/52; 382/1

[58] Field of Search ..... 270/52, 54, 55, 56, 270/57, 58; 382/1, 7

[56] References Cited

U.S. PATENT DOCUMENTS 4,574,692 3/1986 Wahli ..... 270/55

4,580,770 4/1986 Warden ..... 270/58

FOREIGN PATENT DOCUMENTS 57-151564 9/1982 Japan ..... 270/56

57-156966 9/1982 Japan ..... 270/56

57-160861 10/1982 Japan ..... 270/56

*Primary Examiner*—Edward K. Look

*Assistant Examiner*—Therese M. Newholm

*Attorney, Agent, or Firm*—Burns, Doane, Swecker & Mathis

[57] ABSTRACT

A method for checking and combining separate documents having sections of text imprinted thereon for ensuring that documents taken from two or more groups possess the same identical sections of text includes the steps of conveying the documents taken from the groups of documents along a conveyor to a scanning position in front of an opto-electrical scanning device and scanning the documents with the opto-electrical scanning device in order to produce a series of digital signals. The digital signals associated with documents from two different groups of documents are then compared in a comparator to determine if the signals are identical.

8 Claims, 1 Drawing Sheet

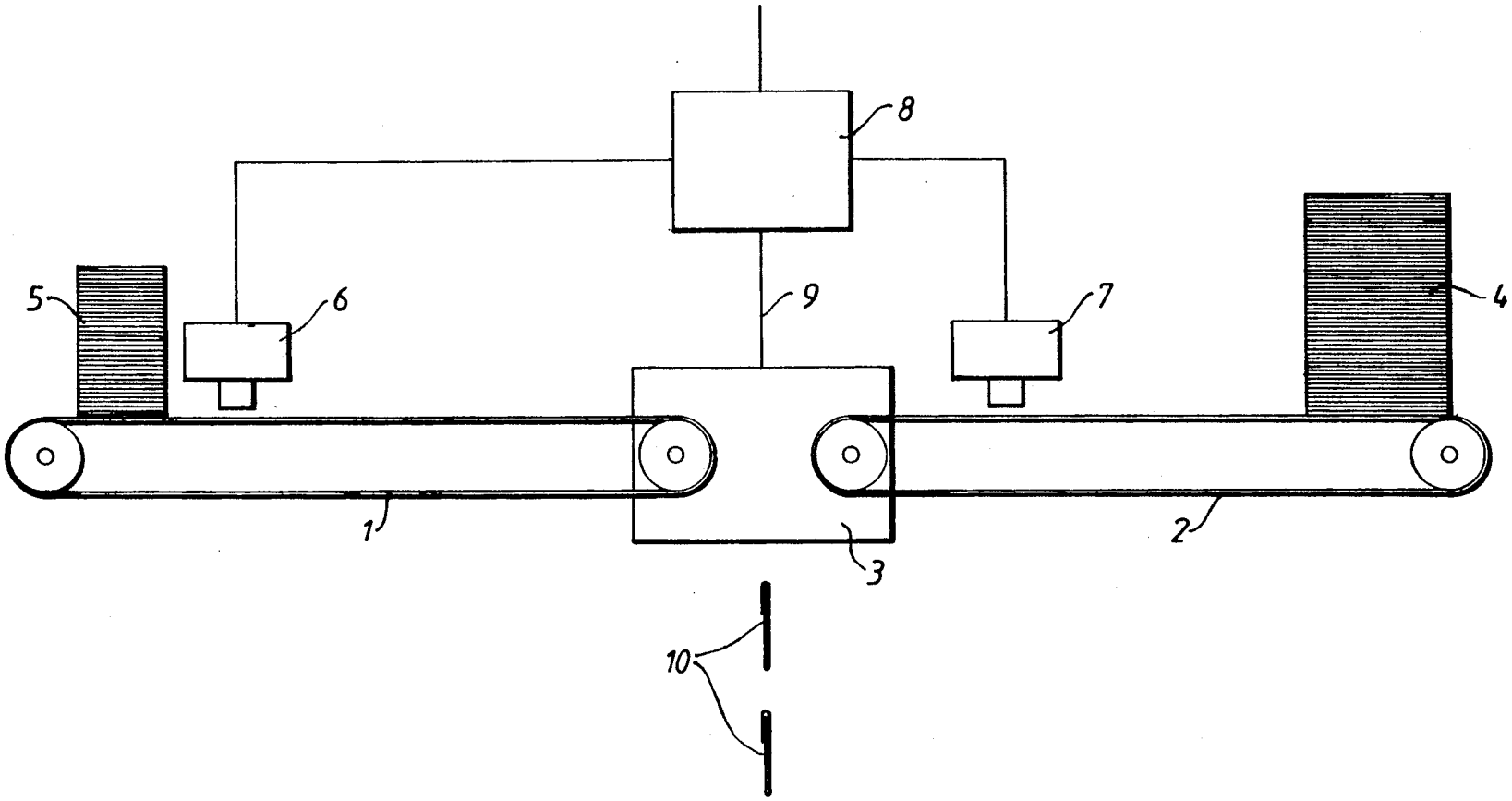
4
2
7
8
3
9
10
1
6
5

METHOD OF CHECKING AND COMBINING SEPARATE DOCUMENTS OR PART DOCUMENTS OF THE LETTER AND ENVELOPE TYPE

FIELD OF THE INVENTION

The present invention relates to a method of checking and combining documents and more particularly, a method of checking and combining separate documents or parts of documents of the letter and envelope type.

BACKGROUND OF THE INVENTION

It is known that separate documents of the letter and envelope type may be combined with the help of automatic machines which fold up the letter paper, open the envelope, insert the folded-up letter in the envelope and then seal the envelope with the letter inside.

It is also known that machines of the abovementioned type may be combined with devices for imprinting the name and address of the envelope as well as the letter. However, the printing of the envelope can be avoided through use of window envelopes which permit the address imprinted on the letter to be visible through the transparent window of the envelope.

In certain cases it is desirable to distribute more personally formulated letters in mass edition, which can be done with the help of modern techniques. Even though such letters contain a large amount of standard text, they will yet include parts directed just to the person to whom the letter is addressed. In the case of such personalized letters it is of great importance that the "right letter reach the right person". The use of so-called window envelopes is considered undesirable in the case of personalized letters and instead the use of envelopes with the address written thereon is perferred, since this underlines the personal character of the letter. The technical problem is to ensure that the right letter is combined with the right addressee. In principle, known devices exist by means of which such a combination can be arrived at with great safety. This can be achieved, for example, by providing the letter as well as the envelope with an electronically readable bar code that corresponds to the name and address of the addressee. However the presence of such a bar code takes away from the personal character of the letter and for this reason, bar code markings are oftentimes avoided.

OBJECTS AND SUMMARY OF THE INVENTION

To solve this problem a method is proposed in accordance with the present invention which in that document or part of the document, e.g. letter and envelope, is conducted by means of a conveyor device to a scanning position in front of an opto-electrical scanning device of the TV-camera type which is allocated to each type of document or document part. The imprinted text sections on the documents or parts of documents are scanned. The result of the scanning operation is defined by an analog video signal which is received in a computer. The computer converts the analog video signal to digital information which is the type of information which a computer can process. When the two pictures which are to be compared have been stored in the computer's memory a comparison of the stored picture information is begun. The comparison is made pixel by pixel and is controlled by a number of parameters in order to compensate for external factors such as e.g. differences in light intensity, dust, angular errors etc.

Should the information deviate more than is permissible according to the parameters which have been set via the software, the machine can be made, via its interface with the machine, to stop the paper feed or indicate an error.

BRIEF DESCRIPTION OF THE DRAWINGS

An embodiment of the invention will be described in greater detail with reference to the drawing, wherein the drawing is a schematic illustration of the apparatus according to the present invention for carrying out the method of the present invention.

DETAILED DESCRIPTION OF THE PREFERRED

As illustrated in the drawing, the apparatus includes two intermittently movable conveyor belts 1 and 2 and a letter inserting and envelop sealing machine 3. A stock of preprinted letter paper 4 and a stock or preprinted envelopes 5 are shown positioned on the conveyor belts 2, 1 respectively. Two TV cameras 6 and 7 and a comparator or comparing device 8. Moreover, a signal line 9 between the comparator 8 are also provided and the device for inserting letters 3 is shown, as is and the finished sealed envelope 10.

The arrangement operates in such a manner that the conveyor devices 1 and 2 are intermittently advanced over a distance corresponding to one step of operation for the letter paper which is delivered from the stack 4 as well as for the envelopes which are delivered from the stack 5. Because the letter paper and envelope often do not have the same dimension, the conveyor device 2, for example, may have a longer feed distance than the conveyor device 1. In the device 3 for insertion of the letter and sealing of the envelope, which may be of a known commercial kind, the letter paper arriving from the conveyor belt 2 is folded, whereafter it is put into an envelope delivered similarly by means of the conveyor belt 1. Thereafter the envelope is sealed and the combined envelope and letter are delivered as a finished item 10. The TV-cameras 6 and 7 are arranged in vibration-absorbing stands and may be adjusted in their position in such a manner that the cameras are synchronized with the delivery of the documents, so that the text section which is to be scanned will be located in front of the cameras 6 and 7.

As mentioned previously, the text section may consist of any kind of text part and may even consist of pictures and the like. The only requirement is that the pictures or text sections on the two documents scanned should be identical in form and preferably also in size. When a document has been delivered to one of the TV-cameras 6, 7 the image of the actual text section will be focussed by means of a system of optical lenses onto a device which converts optical signals to electrical ones, a so-called CCD-chip, which results in a large number of analog signals being generated. These analog signals correspond to the dark and lights portions respectively of the actual text section and may be used for recreating a picture on a TV-screen. In the present case a visual reproduction of the text section on a TV-screen in most cases is of no interest since it is only desired to compare the signals which are generated by the cameras 6 and 7 from the same text section and then determine whether the text sections are identical or not. The scanning of the pictures by means of TV cameras can be done with a varying amount of accuracy depending on the design of the TV-cameras and it can be said that it is possible to divide the field into a certain number of "pixels".

The signals from the TV-cameras 6 and 7 are fed to a comparing device, a so-called comparator 8, wherein the pulses are compared with one another, figuratively speaking, by being placed on top of one another. The comparison is done, of course, electronically with the help of known devices, and since it is a large number of dots or "pixels" which are to be compared with one another total conformity cannot be expected in the comparison because minor differences can exist in the print and the adjustment of the pictures which produce deviations in the scanning. It has been found by experience, however, that a certain percentage of conformity between the mutual positions of the pixels recorded, e.g. 80 to 90%, represent adequate safety for the text sections agreeing with one another. Should the percentage of conforming "pixels" be less, the device would sound the alarm through acoustic or optical signals at the same time as the conveyor belts 1, 2 are stopped to permit a manual correction to be performed. The minium percentage of conforming "pixels" which is considered acceptable for approval of the identity of a text section, may be adjustable and must be set by taking into account the nature of the base material, the light conditions, the appearance of the text etc. In other words it is the sensitivity of the set-up which is adjusted and which, according to experience, must be done so as to ensure at all times that identity exists between the read and compared text section. At the same time the sensitivity of the set-up must not be so great that a large number of text sections, which in reality are identical, fail to be recognized as such, as a result of the inability of the device to achieve absolute conformity of the position of the pictures.

It has been found advantageous not to feed the signals from the TV-cameras 6 and 7 directly into the comparator 8 for comparison, but to store the signals in a memory large enough to accomodate a certain number, say 10 to 15, complete text section readings. The reason why it is advantageous to operate with an intermediate memory between the TV-cameras 6 and 7 and the comparator 8 is that it will not be necessary to completely synchronize the readings by the TV-cameras 6 and 7. Since the readings by the TV-cameras 6 and 7 need not take place at the same time, greater freedom also exists for placing the TV-cameras at points along the conveyor belts 1 and 2 where preconditions for reading are most favourable bearing in mind light conditions, freedom from vibrations, access for service etc. It is possible, therefore, to read one text section with one TV-camera while at the same time reading a wholly different text section on a different document by the other TV-camera 7. In such cases it is necessary, of course, to keep count of the number of documents by which the reading of one TV-camera is offset with respect to the other. That that is to say, how the displacement in the reading cycle between the two TV-cameras must be kept track of so that readings of identical text sections will always be compared at the same time in the comparator 8. This may be done by a simple switching or delay in the memory units which keep count of the extent of the displacement between the documents read.

The system is based on the different documents being previously sorted in the correct order in the document stacks 4 and 5, so that the checking device does not have to be employed. That is the case where absolutely correct sorting exists. Unfortunately, however, it sometimes happens that during handling some documents disappear or are damaged, which means that the delivery of the different documents which are to be sorted will be out of step and that consequently all documents which follow the missing document would be incorrectly combined. However, the present invention solves this monitoring problem and will stop the combination of documents as soon as the system detects that the scanned text sections do not correspond to one another. As mentioned earlier, the text sections must be wholly identical and preferably must be printed by the same printing unit for the checking arrangement to function properly. It is inevitable, though, that in the course of their delivery by the conveyor belts 1 and 2 the documents will be displaced from their nominal delivery positions. The documents may be displaced by as least fractions of millimeters in the longitudinal as well the transverse direction and may also be displaced slightly obliquely. A further source of error may be that the print is not placed accurately in the same place on the different documents even though it is the objective and is a precondition for the system to be able to function. In order to compensate for displacements of the documents delivered, the checking operation is initiated by determining the righthand and lefthand edge limits of the text section scanned. If the distance between these edge limits is not the same as determined through scanning with the different TV-cameras 6, 7, it is quite certain that identity does not exist, and thus, the scanning is stopped. Since the document should lie correctly assorted, the distances between the righthand and lefthand limit edges agree in most cases and adjustment of the pictures of the text sections scanned takes place electronically so that the readings of the text section from the lefthand limit edge commences simultaneously on both text sections. This guarantees that the pulse sequence or "pixel scanning" will be correct across the text section from left to right. In the same manner the lower lefthand limit edges of the text section are scanned, whereafter an electronic adjustment takes place so that the "electronic pictures" of the text section are positionally adjusted vertically as well as laterally. A further adjustment redresses the slop of the text section and this adjustment too can be electronically, so that the bottom righthand and lefthand limit edges are established in their position and compensation for any slope is made electronically. After these adjustments the electronic pictures will "overlap" one another so that scanning of the picture can take place to obtain the signals which, from the two TV-cameras 6 and 7 via an intermediate memory, can be fed to the comparator 8. Depending on the result of the comparison, the comparator 8 either approves the identity of the text section, whereupon the processing of the documents continues, or else fails to recognize the identity of the text section which results in the conveyor belts 1, 2 being stopped so that manual adjustment may be performed. In the present embodiment an arrangement is shown for combining documents consisting of letters and envelopes, both provided with identical text sections, in particular constituting the name and/ address of the addressee. As mentioned earlier, it is also possible to use the arrangement for comparing and conforming documents containing series of numbers, pictures etc., and it is also possible to combine more than two documents by introducing further TV-cameras into the system and by increasing in a corresponding manner the capacity of the intermediate memory and of the comparator 8.

It has been found that the arrangement in accordance with the invention functions with great reliability and that through the use of the arrangement it is possible to avoid a great number of manual checks and to avoid the use of bar codes and other markings which are considered to spoil the appearance of the documents which are to be combined.

While this invention has been illustrated and described in accordance with a preferred embodiment, it is recognized that variations and changes may be made and equivalents employed herein without departing from the invention as set forth in the claims.

What is claimed is:

1. A method of checking and combining separate documents which have a section of text imprinted thereon for ensuring that selected documents taken from two or more groups of documents are combined only if they possess the same sections of text, comprising the steps of:

conveying the selected document taken from each group of documents to a scanning position in front of an opto-electrical scanning device;

scanning the sections of text of each selected document to produce pictures of the sections of text;

electroncially adjusting the slope of each picture as well as the position of each picture in the vertical and lateral directions so that the pictures overlap one another;

scanning the sections of text on each of the selected documents with the opto-electrical scanning device to thereby produce a series of optical signals;

converting the optical signals to digital signals;

comparing the digital signals associated with the selected documents;

determining whether the digital signals associated with the selected documents are identical; and combining the selected documents when the digital signals associated with the selected documents are determined to be identical and preventing the selected documents from being combined when the digital signals associated with the selected documents are determined not to be identical.

2. The method according to claim 1, wherein the selected document from each group of documents is scanned by an opto-electrical scanning device that is associated with that particular group of documents.

3. The method according to claim 1, wherein the documents in each group that are to be combined with one another are arranged in the same order.

4. The method according to claim 1, wherein said optical signals associated with each of said selected documents are stored in a memory prior to being compared with one another.

5. The method according to claim 1, wherein said selected documents are scanned by a TV-camera.

6. A method of checking and combining envelopes and letters which have lines of text imprinted thereon for ensuring that a selected envelope taken from one group and a selected letter taken from another group are combined only if they possess the same identical lines of text, wherein the envelopes in the group of envelopes and the corresponding letters in the group of letter that are to be combined with one another are arranged in the same order, comprising the steps of:

conveying the selected envelope and letter along a conveyor to a scanning position in front of an opto-electrical scanning device;

scanning the sections of text of the selected envelope and letter to produce pictures of the lines of text;

electronically adjusting the slope of each picture as well as the vertical and lateral position of the pictures so that the pictures overlap one another;

scanning the lines of text on the selected envelope and letter with different opto-electrical scanning devices to thereby produce a series of optical signals;

converting the optical signals to analog signals;

converting the analog signals to digital signals;

comparing the digital signals associated with the selected envelope and letter in a comparator;

determining whether the digital signals associated with the selected envelope and letter are the same; and combining the selected envelope and letter when the digital signals associated with the selected envelope and letter are determined to be the same and preventing the selected envelope and letter from being combined when digital signals associated with the selected envelope and letter are determined not to be the same.

7. The method according to claim 6, wherein said optical signals associated with said selected envelope and letter are stored in a memory prior to being compared with one another.

8. The method according to claim 7, wherein the selected envelope and letter are scanned by a T.V. camera in order to produce the optical signals.

* * * * *